US012692032B2

(12) United States Patent
Felsecker et al.

(10) Patent No.: US 12,692,032 B2
(45) Date of Patent: Jul. 28, 2026

(54) PRESS-TYPE STRAPPING MACHINE WITH PLATEN-LOCKING SYSTEM

(71) Applicant: Signode Industrial Group LLC, Tampa, FL (US)

(72) Inventors: Douglas Felsecker, Saint Charles, IL (US); Joel Patel, Hawthorn Woods, IL (US); Joseph Edward Lininger, Union Grove, WI (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 237 days.

(21) Appl. No.: 18/291,485

(22) PCT Filed: Jul. 29, 2021

(86) PCT No.: PCT/US2021/043685

§ 371 (c)(1),
(2) Date: Jan. 23, 2024

(87) PCT Pub. No.: WO2023/009123

PCT Pub. Date: Feb. 2, 2023

(65) Prior Publication Data

US 2024/0343431 A1 Oct. 17, 2024

(51) Int. Cl.
*B65B 13/20* (2006.01)
*B65B 13/04* (2006.01)

(52) U.S. Cl.
CPC ..... *B65B 13/20* (2013.01); *B65B 13/04* (2013.01)

(58) Field of Classification Search
CPC ..... B65B 13/04; B65B 13/20; B65B 13/18; B30B 15/28; B30B 15/287; B30B 15/288;
(Continued)

(56) References Cited

U.S. PATENT DOCUMENTS 1,218,021 A 3/1917 Walther
2,887,911 A * 5/1959 Bunting ..... B23Q 5/32 408/76

(Continued)

FOREIGN PATENT DOCUMENTS

CN 106219456 A 12/2016
CN 208898439 U 5/2019

(Continued)

OTHER PUBLICATIONS

"International Search Report and Written Opinion", from corresponding PCT/US2021/043685, Apr. 25, 2022.

*Primary Examiner* — Jimmy T Nguyen
(74) *Attorney, Agent, or Firm* — Neal, Gerber & Eisenberg LLP

(57) ABSTRACT

A press-type strapping machine with a platen-locking system is provided. When the platen-locking system is in a locked configuration, it prevents the platen from descending regardless of its vertical position. The strapping machine includes a machine frame; a load supporter configured to support and move the load; a platen configured to compress the load against the load supporter; and a platen-locking system including a ratchet wheel, a locking arm, and an actuator operably connected to the locking arm and configured to move the locking arm relative to the ratchet wheel from a locked position to an unlocked position. When the locking arm is in the locked position, the locking arm engages the ratchet wheel in a manner that prevents the platen from descending. When the locking arm is in the unlocked position, the locking arm is disengaged from the ratchet wheel such that the platen can descend.

20 Claims, 8 Drawing Sheets

(58) Field of Classification Search
CPC .. G05G 5/06; G05G 5/14; G05G 5/18; G05G 5/20; G05G 5/24; G05G 5/26; B66F 2700/02; B66F 2700/03; B66D 5/20
See application file for complete search history.

(56) References Cited

U.S. PATENT DOCUMENTS

| | | | | |
|---|---|---|---|---|
| 3,762,235 | A | 10/1973 | Splinter | |
| 3,934,680 | A | 1/1976 | Bishop | |
| 4,046,019 | A | 9/1977 | Phillips | |
| 4,076,104 | A | 2/1978 | Bishop et al. | |
| 4,976,336 | A | 12/1990 | Curran | |
| 6,382,358 | B1 | 5/2002 | Kritzer | |
| 7,207,419 | B2 | 4/2007 | Fore et al. | |
| 8,840,087 | B2 * | 9/2014 | Guyard | B66F 3/02 254/350 |
| 9,145,283 | B2 | 9/2015 | Oehm et al. | |
| 2005/0287240 | A1 | 12/2005 | Mattias et al. | |
| 2006/0144653 | A1 | 7/2006 | Eberle et al. | |
| 2017/0313014 | A1 * | 11/2017 | Kimura | B30B 15/287 |
| 2020/0139657 | A1 * | 5/2020 | Termanas | B65B 57/10 |

FOREIGN PATENT DOCUMENTS

| | | | |
|---|---|---|---|
| CN | 210915144 | U | 7/2020 |
| CN | 210936856 | U | 7/2020 |
| CN | 211419496 | U | 9/2020 |
| CN | 212076336 | U | 12/2020 |
| CN | 112408243 | A | 2/2021 |
| DE | 29805196 | U1 | 7/1998 |
| EP | 1355074 | A1 | 10/2003 |
| FR | 2710361 | A1 | 3/1995 |

* cited by examiner

PRESS-TYPE STRAPPING MACHINE WITH PLATEN-LOCKING SYSTEM

PRIORITY

This application is a national phase application of and claims priority to and the benefit of PCT/US2021/043685, filed on Jul. 29, 2021, the entire contents of which is incorporated herein by reference.

FIELD

The present disclosure relates to press-type strapping machines including platens that compress loads before strapping them, and more particularly to press-type strapping machines with a platen-locking system that, when activated, prevents the platen from descending.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components. To strap the load, the strapping head first feeds strap (leading strap end first) from a strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head then cuts the strap from the strap supply to form a trailing strap end and attaches the leading and trailing strap ends to one another, thereby forming a tensioned strap loop around the load. Certain strapping machines have multiple strapping heads and respective strap chutes that define respective strap paths. These strapping machines are configured to simultaneously form multiple tensioned strap loops (using strap from separate respective strap supplies) around a load.

Press-type strapping machines are configured to apply a compressive force to the load to partially compress the load, such as to partially compress a stack of flattened corrugated sheets, before strapping the load using multiple strapping heads. A typical press-type strapping machine includes a platen supported by the frame and vertically movable relative to the support surface and the load. Before strapping the load, the platen moves downward toward the support surface and into contact with the load. As the platen continues moving downward, it applies a compressive force to the load and starts compressing the load. As this occurs, the controller monitors the applied compressive force the platen applies to the load, and stops the platen once the applied compressive force reaches a target compressive force. At this point, the load is partially compressed, and the controller controls the strapping heads to strap the load. The platen then moves upward (away from the support surface and the load) to disengage the load and enable the load to be moved out of the strapping machine. As the platen moves upward and disengages the load, the load attempts to return to its original height by expanding upward. As this occurs, the strap loops stretch slightly ender this expansion force but prevent full expansion such that the strapped load is shorter than it was before compression and strapping but taller than it was when compressed. Compressing the loads before strapping not only makes the loads more compact and easier to store and handle, but also ensures the straps tightly bind the load together.

Certain known press-type strapping machines include suspension brackets used to suspend the platen in place a particular distance above the support surface. This ensures the platen cannot descend when, for instance, the strapping machine is deenergized for service or other downtime. To do so, the operator controls the strapping machine to move the platen to a particular position above the support surface. While the motor controlling the platen suspends it in place, the operator manually unlocks and moves the suspension brackets into place below the platen. The operator then controls the strapping machine to move the platen downward into contact with the suspension brackets so the platen rests on the suspension brackets, at which point the strapping machine can be deenergized. One problem with existing suspension brackets is that they can only suspend the platen in place at one particular position, which requires the operator to move the platen to a specific place each time the operator wants to suspend the platen in place. Another problem with these suspension brackets is that they require the operator to manually move them into place below the platen, which requires the operator to move away from the control area to manually put the suspension brackets in place. Not only is this inconvenient for operators, but it also takes time to complete, reducing efficiency.

SUMMARY

Various embodiments of the present disclosure provide a press-type strapping machine with a platen-locking system, that, when in a locked configuration, prevents the platen from descending regardless of its vertical position. The strapping machine includes a machine frame; a load supporter configured to support and move the load; a platen configured to compress the load against the load supporter; and a platen-locking system including a ratchet wheel, a locking arm, and an actuator operably connected to the locking arm and configured to move the locking arm relative to the ratchet wheel from a locked position to an unlocked position. When the locking arm is in the locked position, the locking arm engages the ratchet wheel in a manner that prevents the platen from descending. When the locking arm is in the unlocked position, the locking arm is disengaged from the ratchet wheel such that the platen can descend.

DETAILED DESCRIPTION

Figure 1:
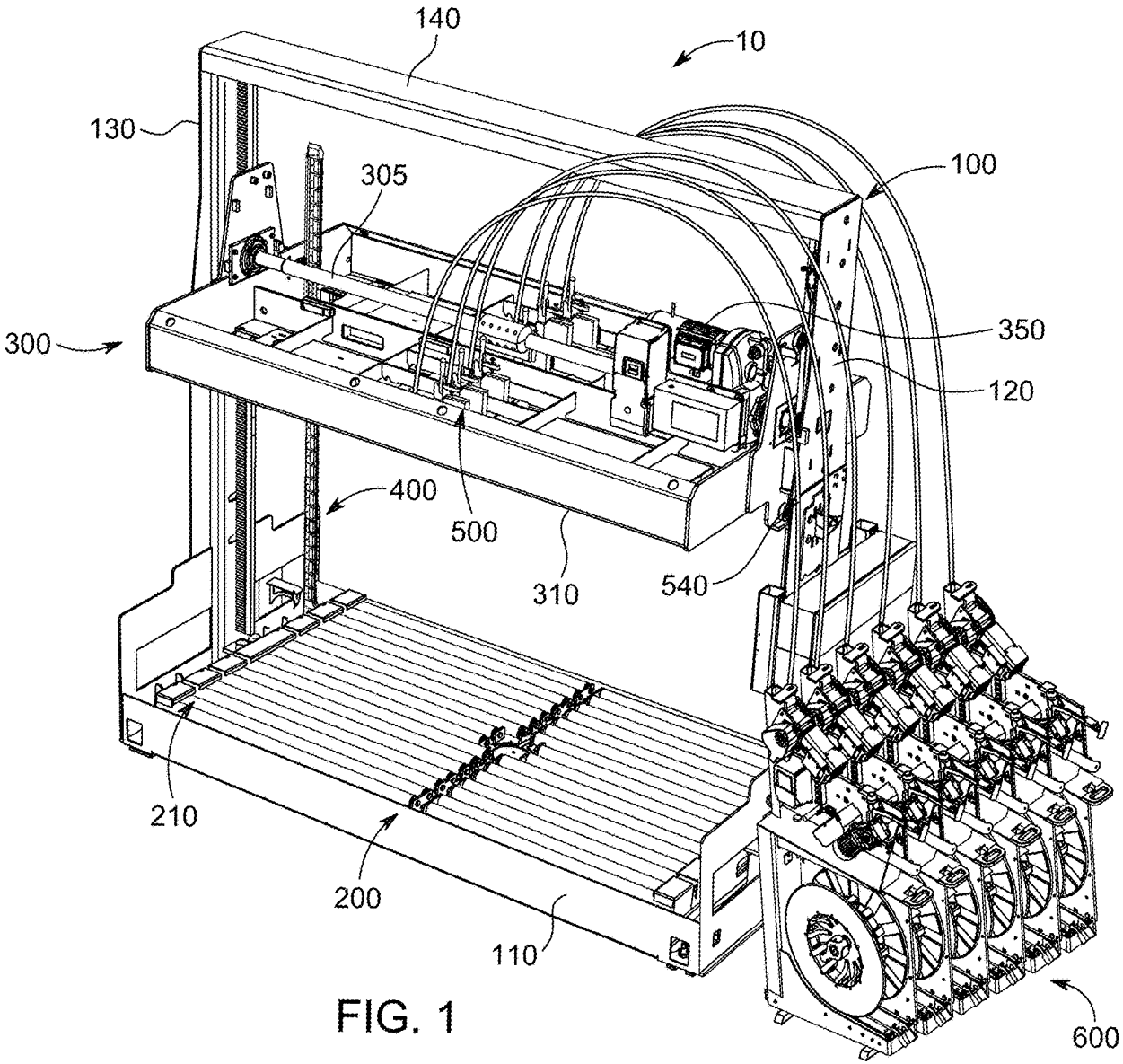
FIGS. 1 and 2 are perspective views of one example embodiment of a press-type strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a press-type strapping machine with a platen-locking system, that, when in a locked configuration, prevents the platen from descending regardless of its vertical position. FIGS. 1-6C show one embodiment of the press-type strapping machine 10 of the present disclosure (referred to as the "strapping machine" below for brevity) and components thereof. The strapping machine 10 includes a machine frame 100; a load supporter 200; a platen 300; a platen actuator 350; a platen-locking system (not numbered); multiple strap chutes 400 (only one of which is shown and labeled for clarity); multiple strapping heads 500 (only one of which is labeled for clarity) each configured to draw strap from a respective strap supply 600 (only one of which is labeled for clarity); and a controller 800.

Figure 2:
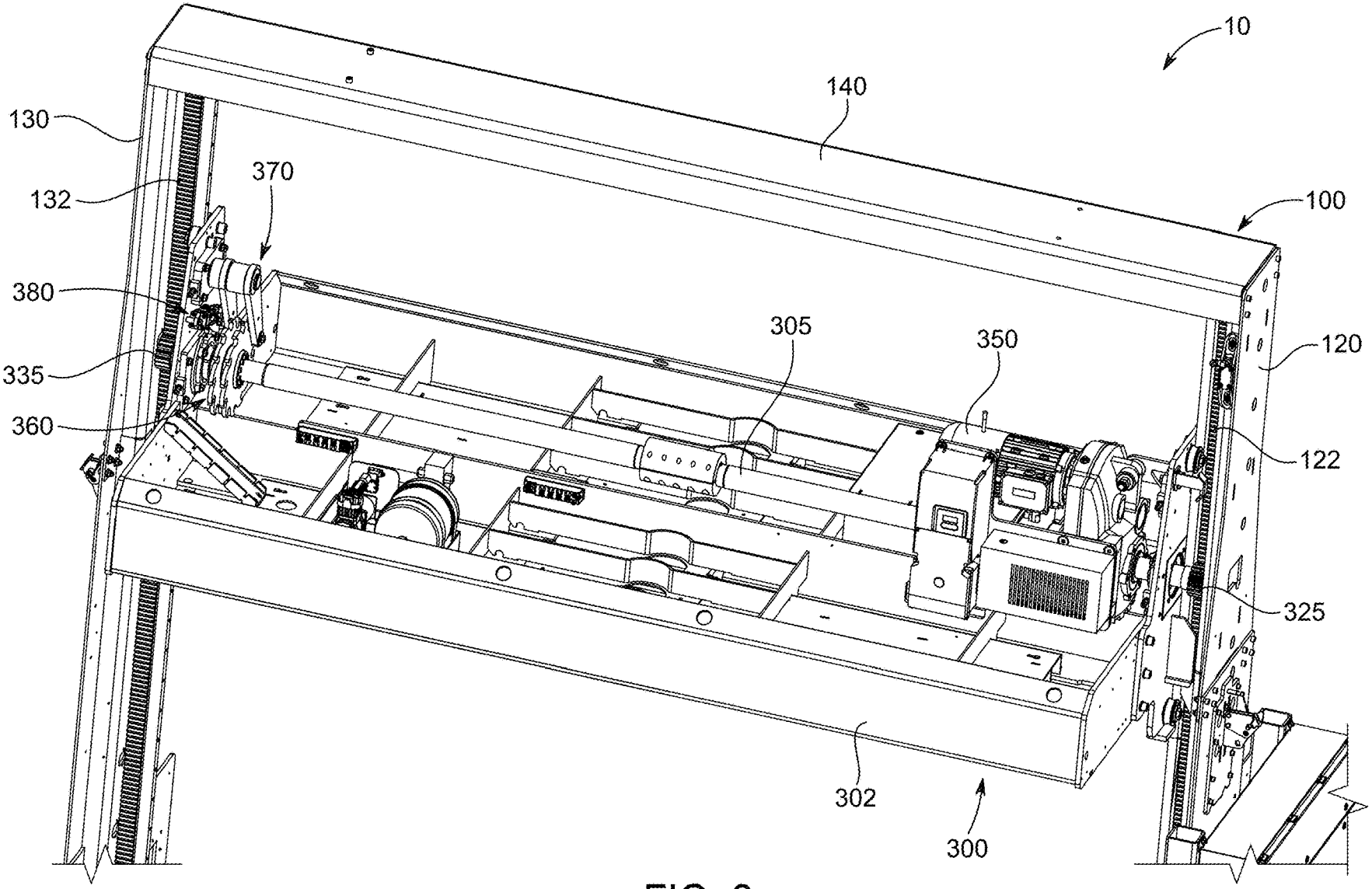

The machine frame 100, which is best shown in FIGS. 1 and 2, is configured to support some (or in certain embodiments all) of the other components of the strapping machine 10. In this example embodiment, the machine frame 100 includes a base 110, first and second spaced-apart upstanding legs 120 and 130, and connector 140 that spans and connects the upper ends of the first and second legs 120 and 130. The first and second legs 120 and 130 include respective vertically extending toothed racks 122 and 132 that (as described below) enable the platen 300 to move relative to the first and second legs 120 and 130 in a rack-and-pinion fashion. This is merely one example of a configuration of components that form the machine frame 100, and any other suitable configuration of any other suitable components may form the machine frame 100 in other embodiments.

The load supporter 200, which is best shown in FIG. 1, is configured to support and move loads through the strapping machine 10. The load supporter 200 includes a load-supporter frame and a conveyor actuator (not shown). The conveyor 210 is mounted to the load-supporter frame and is configured to support loads during compression and strapping and to move loads through the strapping machine 10. In this example embodiment, the conveyor 210 includes first and second sets of aligned rollers (not labeled). The conveyor actuator is operably connected to the rollers—such as via gearing, chains, belts, and the like—to drive the rollers. The conveyor actuator may be any suitable actuator, such as an electric, pneumatic, or hydraulic motor. The load supporter 200 is mounted to the base 110 of the machine frame 100 between the first and second legs 120 and 130 and below the connector 140.

The platen 300, which is best shown in FIG. 2, is configured to apply a compressive force to the loads to partially compress them before strapping. The platen 300 includes a platen frame 302 that supports the platen actuator 350 (described below). The platen frame 302 is movably mounted to the first and second legs 120 and 130 of the machine frame 100 above the load supporter 200 and is vertically movable relative to the load supporter 200 so the platen 300 can adjust to loads of different heights and apply a compressive force to the loads. More specifically, the platen 300 includes a drive shaft 305 rotatably supported by the platen frame 302 (such as via bearings). A first pinion 325 is fixed to one end of the drive shaft 305, and a second pinion 335 is fixed to the other end of the drive shaft 305. The pinions 325 and 335 are fixed to the drive shaft 305 via a splined connection, a keyed connection, a coupler, or in any other suitable manner so the drive shaft 305 and the pinions 325 and 335 rotate together. The drive shaft 305 extends between the first and second legs 120 and 130 of the machine frame 100 such that the first pinion 325 meshes with the toothed rack 122 of the first leg 120 and the second pinion 335 meshes with the toothed rack 132 of the second leg 130.

In this example embodiment, the platen actuator 350 is operably connected to the drive shaft 305 (and therefore the pinions 325 and 335) via gearing (not shown) such that rotation of an output shaft (not shown) of the platen actuator 350 results in rotation of the drive shaft 305 and the pinions 325 and 335. This rotation of the pinions 325 and 335 (which rotate together via their fixed connection to the drive shaft 305) causes the pinions to climb or descend their respective toothed racks 122 and 132 such that the platen 300 moves away from or toward the conveyor 210 of the load supporter 200 (i.e., ascends or descends). Specifically, rotating the output shaft of the platen actuator 350 in a first rotational direction results in rotation of the drive shaft 305 (and the pinions 325 and 335) in a raising rotational direction and movement of the platen 300 away from the conveyor 210. Conversely, rotating the output shaft of the platen actuator in a second rotational direction opposite the first rotational direction results in rotation of the drive shaft 305 (and the pinions 325 and 335) in a lowering rotational direction and movement of the platen 300 toward the conveyor 210. The platen actuator 350 includes any suitable actuator, such as an electric, pneumatic, or hydraulic motor, operably connected to the platen 300 to move the platen 300 relative to the first and second legs 120 and 130 toward and away from the conveyor 210 of the load supporter 200 (i.e., downward and upward). This is merely one example embodiment of the platen actuator, and any suitable actuator may be employed. Additionally, any other suitable manner of controlling vertical movement of the platen 300 may be employed (e.g., hydraulic or pneumatic cylinders, belt-and-pulley assemblies, and the like), as the rack-and-pinion configuration is merely one example embodiment.

The strap chute 400 circumscribes the conveyor 210 and defines a strap path that the strap follows when fed through the strap chute 400 and from which the strap is removed when retracted. The strap chute 400 includes two spaced-apart first and second upstanding legs (not labeled), an upper connecting portion (not shown) that spans the first and second legs and is positioned in the platen 300, a lower connecting portion (not shown) that spans the first and second legs and is positioned in the load supporter 200, and elbows that connect these portions. As is known in the art, the radially inward wall of the strap chute 400 is formed from multiple overlapping gates that are spring biased to a closed position that enables the strap to traverse the strap path when fed through the strap chute 400. When the strapping head 500 later exerts a pulling force on the strap to retract the strap, the pulling force overcomes the biasing force of the springs and causes the gates to pivot to an open position, thereby releasing the strap from the strap chute so the strap contacts the load as the strapping head 500 continues to retract the strap.

The strapping head 500 is configured to form a tensioned strap loop around the load by feeding the strap through the strap chute 400 along the strap path, holding the leading strap end while retracting the strap to remove it from the strap chute 400 so it contacts the load, tensioning the strap around the load to a designated tension, cutting the strap from the strap supply to form a trailing strap end, and connecting the leading strap end and trailing strap end to one another. In this example embodiment, the strapping head 500 is a modular strapping head including independently removable and replaceable feed, tensioning, and sealing modules. The feed module, which is configured to feed and retract the strap, and the tensioning module, which is configured to tension the strap, are mounted to a frame (not labeled) of the strap supply 600. That is, in this example embodiment, the feed and tensioning modules are located remote from the strapping machine 10 (though in other embodiments the feed and/or tensioning modules may be supported by the machine frame 100, the platen 300, or any other suitable component of the strapping machine 10). The platen 300 supports the sealing module, which is configured to hold the leading strap end, cut the strap from the strap supply, and connect the leading strap end and trailing strap end to one another. A strap guide 540 extends between the feed and tensioning modules and the sealing module and is configured to guide the strap as it moves between the modules.

This is merely one example strapping head, and the strapping machine 10 may include any suitable modular strapping head or non-modular strapping head (i.e., a strapping head that is not comprised of independently removable and replaceable feed and sealing modules). The manner of attaching the leading and trailing strap ends to one another depends on the type of strapping machine and the type of strap. Certain strapping machines configured for plastic strap include strapping heads with friction welders, heated blades, or ultrasonic welders configured to attach the leading and trailing strap ends to one another. Some strapping machines configured for plastic strap or metal strap include strapping heads with jaws that mechanically deform (referred to as "crimping" in the industry) or cut notches into (referred to as "notching" in the industry) a seal element positioned around the leading and trailing strap ends to attach them to one another. Other strapping machines configured for metal strap include strapping heads with punches and dies configured to form a set of mechanically interlocking cuts in the leading and trailing strap ends to attach them to one another (referred to in the strapping industry as a "sealless" attachment). Still other strapping machines configured for metal strap include strapping heads with spot, inert-gas, or other welders configured to weld the leading and trailing strap ends to one another.

The platen-locking system is activatable to prevent the platen 300 from descending. The platen-locking system has a locked configuration in which the platen-locking system prevents the platen 300 from descending and an unlocked configuration in which the platen-locking system does not prevent the platen 300 from descending. The platen-locking system includes a ratchet-wheel assembly 360, a locking arm 370, a locking-arm actuator 380, and an actuator-control system 390. In this example embodiment the platen-locking system is separate from the platen actuator 350.

Figure 4:
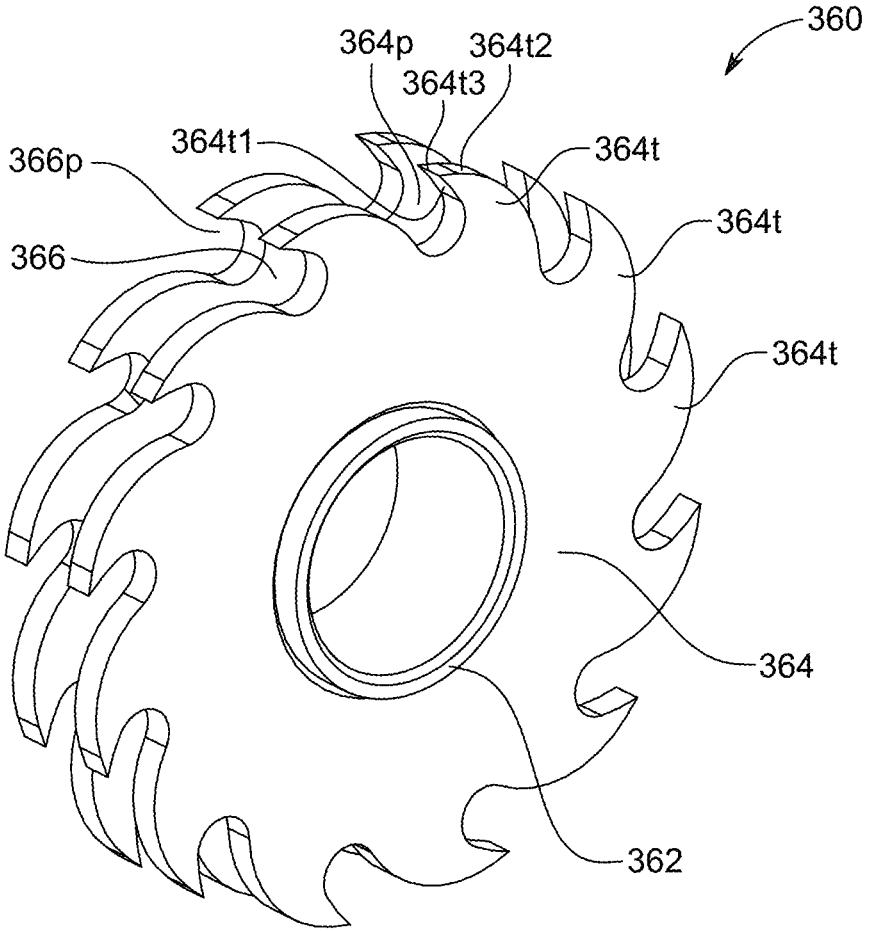
FIG. 4 is a perspective view of the ratchet-wheel assembly of the platen-locking system of the press-type strapping machine of FIG. 1.

The ratchet-wheel assembly 360 is best shown in FIG. 4 and includes a hub 362, a first ratchet wheel 364, and a second ratchet wheel 366. The first ratchet wheel 364 has an annular body (not labeled) including multiple radially extending curved teeth 364*t* around its outer perimeter. Each tooth 364*t* is formed by a curved inner surface 364*t*1 and a curved outer surface 364*t*2 that join at a pointed tip 364*t*3. The teeth 364*t* all curve in the same direction, and a pocket 364*p* (sized to receive the locking finger 374 of the locking arm 370 as described below) separates each pair of adjacent teeth. The second ratchet wheel 366 is identical to the first ratchet wheel 364 and is not separately described, though similar element numbers are used below for ease of reference with a "6" replacing the "4." The first and second ratchet wheels 364 and 366 are fixedly attached to the hub 362 such that they are rotationally aligned and laterally spaced apart.

The ratchet-wheel assembly 360 is fixedly mounted to the drive shaft 305 via a splined connection, a keyed connection, a coupler, or in any other suitable manner so the ratchet-wheel assembly 360 and the drive shaft 305 pivot together. The ratchet-wheel assembly 360 is oriented relative to the drive shaft 305 such that the teeth 364*t* and 366*t* of the first and second ratchet wheels 364 and 366 curve in the lowering rotational direction. This orientation enables the ratchet-wheel assembly 360 to engage the locking arm 370 to prevent the ratchet-wheel assembly 360—and the drive shaft 305—from rotating in the lowering rotational direction and, therefore, from lowering the platen 300.

Figure 5:
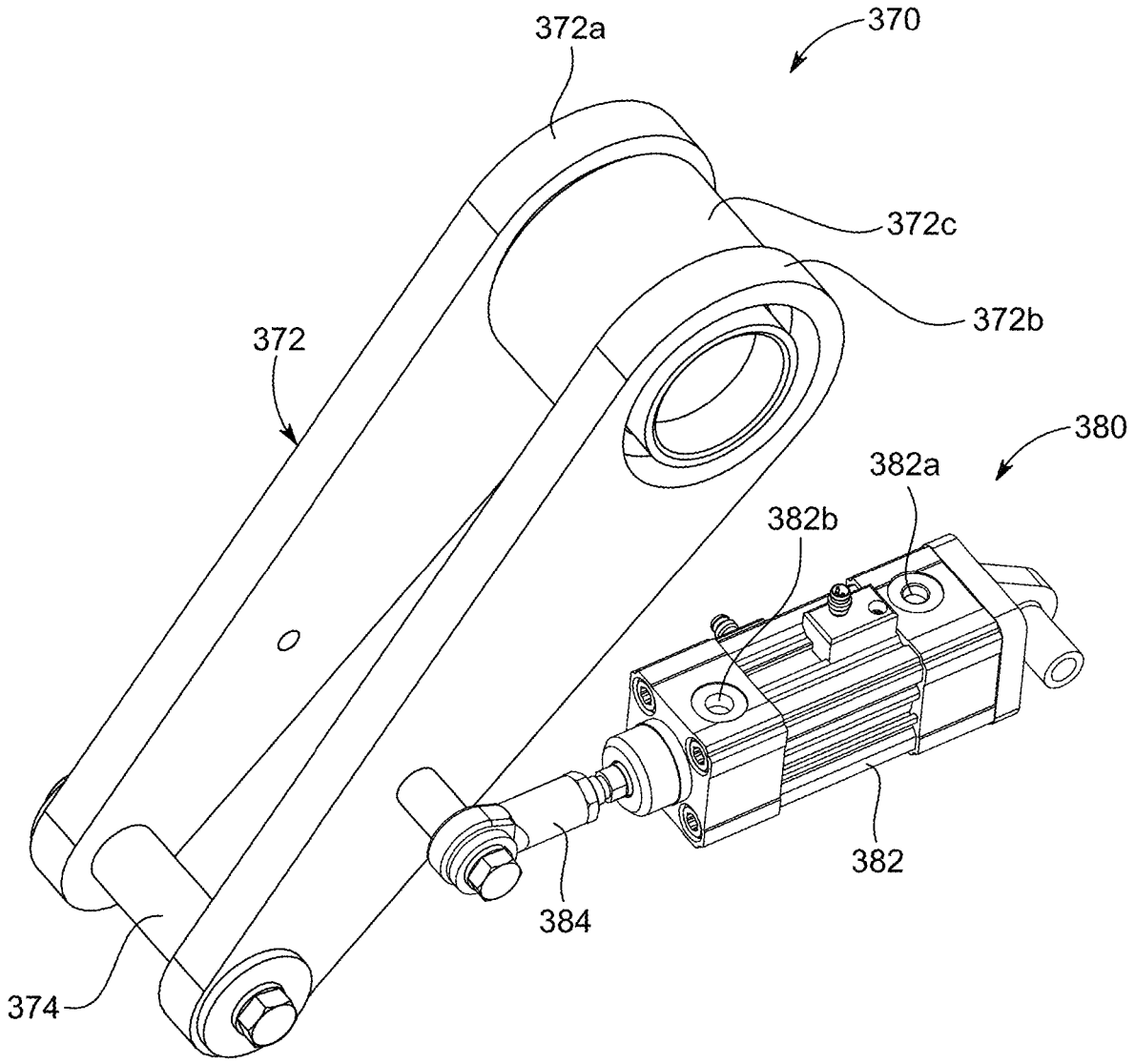
FIG. 5 is a perspective view of the locking arm and the locking-arm actuator of the platen-locking system of the press-type strapping machine of FIG. 1.
Figure 6A:
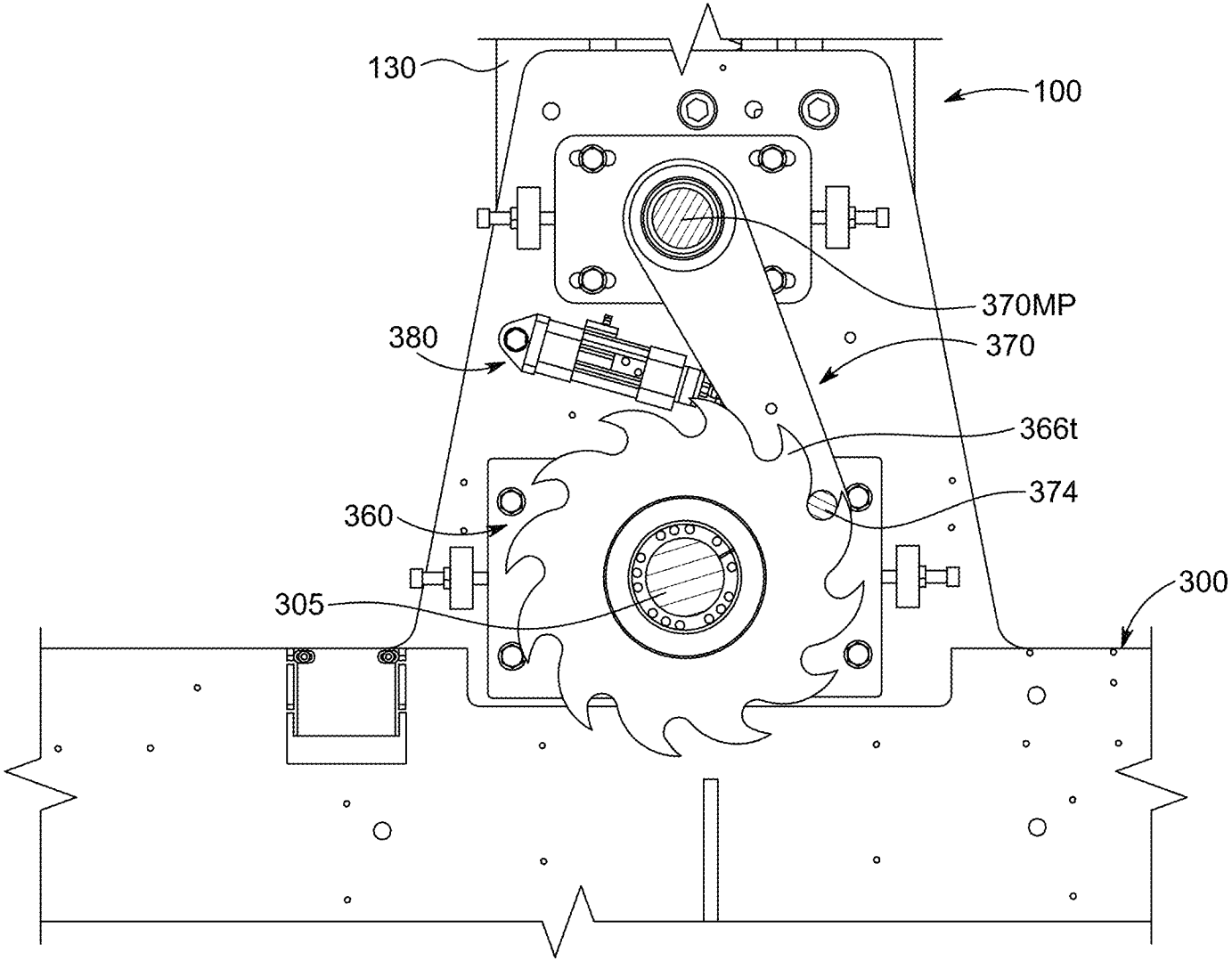
FIG. 6A is a cross-sectional side view of the strapping machine of FIG. 1 with the locking arm in the locked position.
Figure 6B:
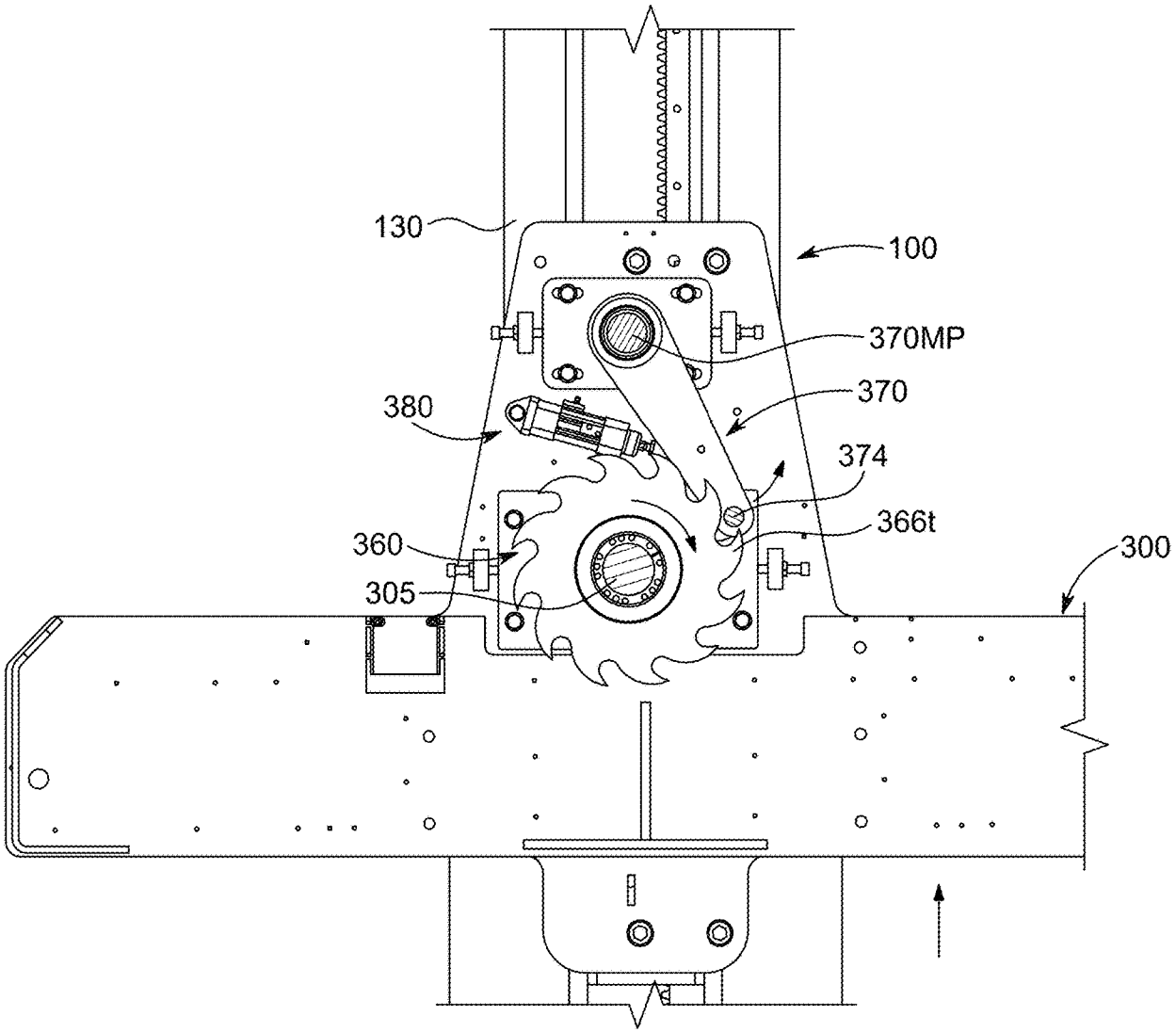
FIG. 6B is a cross-sectional side view similar to FIG. 6A but with the locking arm between the locked and unlocked positions.
Figure 6C:
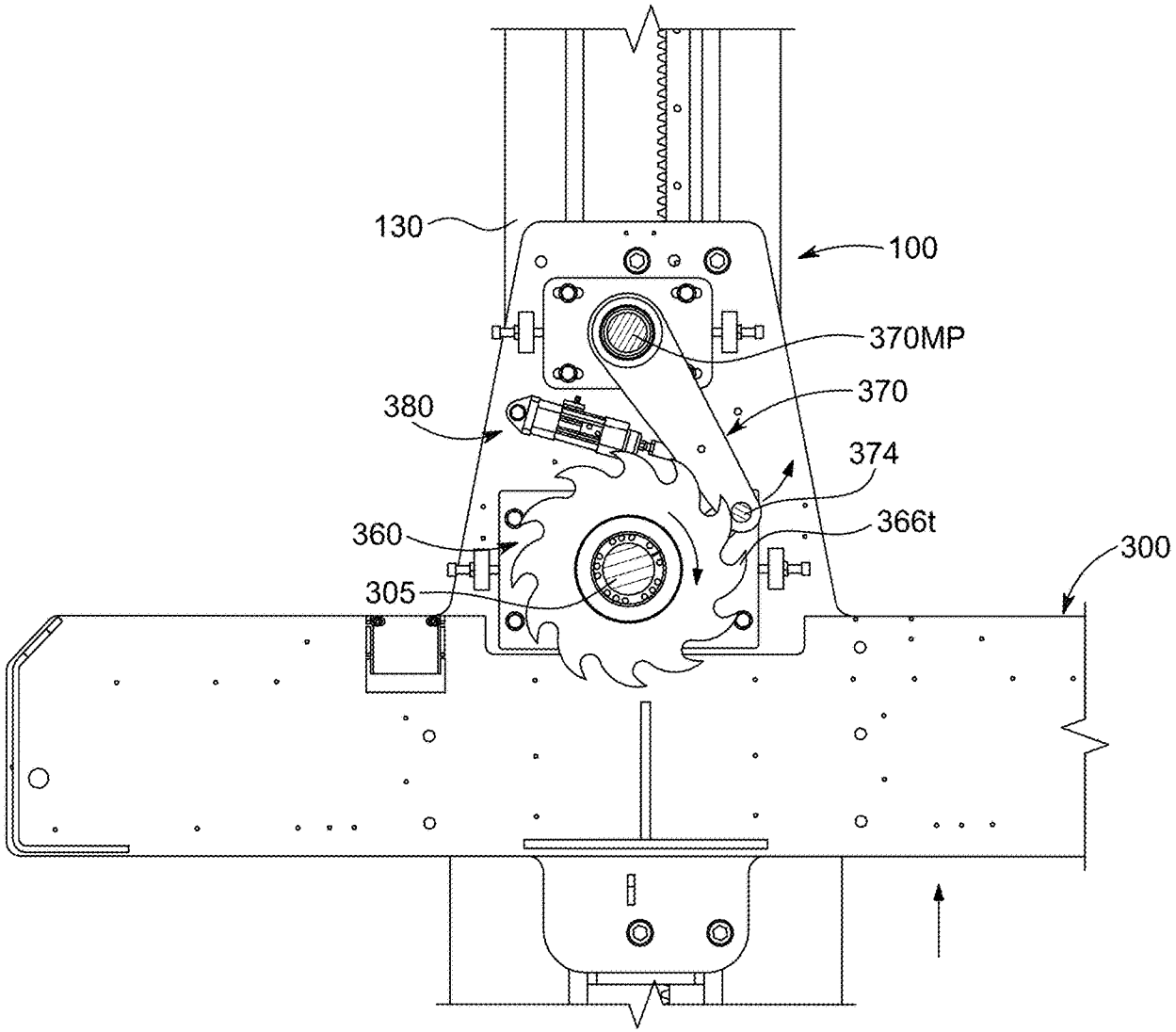
FIG. 6C is a cross-sectional side view similar to FIG. 6A but with the locking arm in the unlocked position.

The locking arm 370 is best shown in FIG. 5 and includes a locking-arm body 372 supporting a locking finger 374 at one end. In this example embodiment, the locking-arm body 372 is formed from two spaced-apart plates 372*a* and 372*b* connected via a sleeve 372*c*, though the body may take any other form in other embodiments. As best shown in FIGS. 6A-6C, the locking arm 370—and particularly the end opposite the locking finger 374—is mounted to the platen frame 302 via a locking-arm mounting pin 370MP such that the locking arm 370 can rotate about the locking-arm mounting pin 370MP relative to the platen frame 302. In this example embodiment, the locking-arm mounting pin 370MP is positioned above the drive shaft 305 and has an axis of rotation that is parallel to (and in this embodiment directly above) the axis of rotation of the drive shaft 305.

The locking-arm actuator 380 is best shown in FIG. 5 and in this example embodiment includes a double-acting pneumatic cylinder. Specifically, the locking-arm actuator 380 includes a cylinder 382, a piston (not shown) slidably disposed in the cylinder 382, and a piston rod 384 having one end attached to the piston inside the cylinder 382 and an opposing end outside the cylinder 384. A first opening 382*a* defined in the cylinder 382 enables pressurized air to be introduced into the cylinder 382 on one side of the piston, and a second opening 382*b* defined in the cylinder 382 enables pressurized air to be introduced into the cylinder 382 on the opposite side of the piston. The piston is movable within the cylinder 382 between: (1) a first position in which the piston is positioned near a first end of the cylinder 382 and the piston rod 384 is in an extended position; and (2) a second position in which the piston is positioned near a second end of the cylinder 382 and the piston rod 384 is in a retracted position. Introduction of pressurized air into the first connector opening 382*a* pressurizes the cylinder 382 in a way that causes the piston to move to the first position to extend the piston rod 384. Conversely, introduction of pressurized air into the second connector 382*b* pressurizes the cylinder 382 in a way that causes the piston to move to the second position to retract the piston rod 384. The locking-arm actuator 380 may be any other suitable actuator, such as a single-acting pneumatic cylinder with a spring return, a hydraulic actuator, or an electric actuator (such as a motor).

The locking-arm actuator 380 is operably connected to the locking arm 370 to control movement (here, pivoting) of the locking arm 370 relative to the ratchet-wheel assembly 360 between a locked position (FIG. 6A) and an unlocked position (FIG. 6C). More specifically, the piston rod 384 of the locking-arm actuator 380 is attached to the body 372 of the locking arm 370 between its two ends. In this configuration, when the piston in the cylinder 382 is in the first position and the piston rod 384 is thus in the extended position, the locking arm 370 is in its unlocked position. Movement of the piston from the first position to the second position retracts the piston rod 384, which pulls the locking arm 370 to its locked position.

When the locking arm 370 is in its locked position, as shown in FIG. 6A, the locking finger 374 is received in and extends between respective pockets 364*p* and 366*p* between consecutive rotationally aligned teeth 364*t* and 366*t* of the first and second ratchet wheels 364 and 366 of the ratchet-wheel assembly 360. The locking arm 370 is angled relative to the ratchet-wheel assembly 360 such that, when in the locked position, the locking arm 370 prevents rotation of the ratchet-wheel assembly 360—and the drive shaft 305 that the ratchet-wheel assembly 360 is attached to—from rotating in the lowering rotational direction. In this example embodiment, the ratchet-wheel assembly 360, and particularly the teeth 364*t* and 366*t*, are shaped and oriented to prevent the locking arm 370 from rotating from its locked position to its unlocked position. Accordingly, when the locking arm 370 is in its locked position: (1) the drive shaft 305 is prevented from rotating in the lowering rotational direction and lowering the platen 300, and (2) the locking arm 370 is prevented from rotating to its unlocked position. The platen-locking system is in its locked configuration when the locking arm 370 is in its locked position. Although not included in this example embodiment, in other embodiments the platen-locking system includes a biasing element (such as a torsion spring or an extension spring) that biases the locking arm to its locked position.

In this example embodiment, to move the locking arm 370 from its locked position to its unlocked position, the ratchet-wheel assembly 360 is first be rotated in the raising rotational direction. As shown in FIG. 6B, the drive shaft 305 is rotated in the raising rotational direction, which rotates the ratchet-wheel assembly 360 attached to the drive shaft 305. As the ratchet-wheel assembly 360 rotates, the teeth 364*t* and 366*t* eventually stop blocking the locking arm 370, and locking finger 374 exits the pockets 364*p* and 366*p* of the first and second ratchet wheels 364 and 366 and rotates to the unlocked position, as shown in FIG. 6B. when in the unlocked position, the locking finger 374 is disengaged from the ratchet-wheel assembly 360 such that the drive shaft 305 and the ratchet-wheel assembly 360 can freely rotate in the lowering rotational direction and lower the platen 300. In other embodiments, the teeth are shaped and oriented such that the locking arm can freely move between its locked and unlocked positions without rotating the ratchet-wheel assembly or the drive shaft. The platen-locking system is in its unlocked configuration when the locking arm 370 is in its unlocked position.

Figure 3:
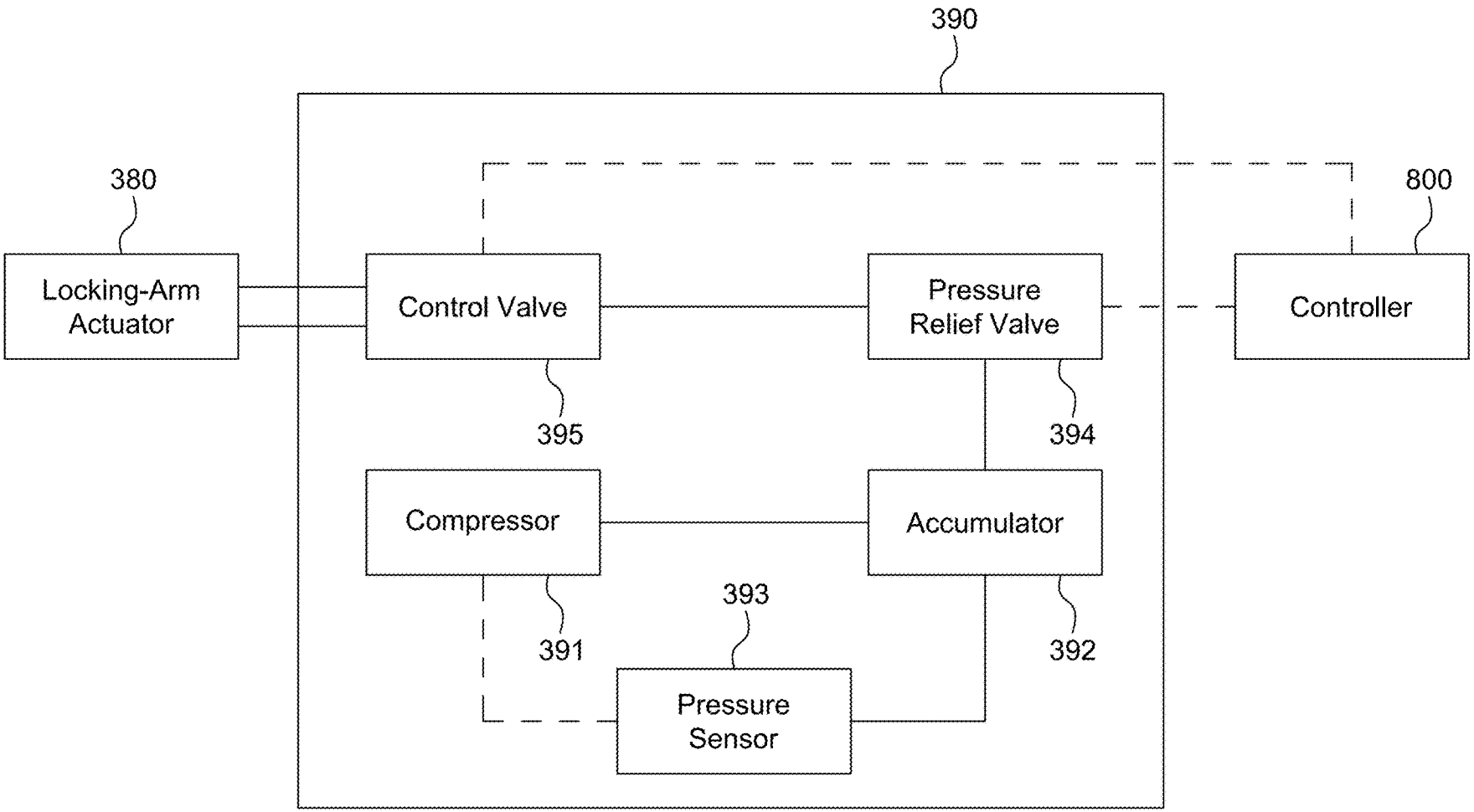
FIG. 3 is a block diagram showing certain components of the press-type strapping machine of FIG. 1.

The actuator-control system 390 is operably connected to the locking-arm actuator 380 to control the locking-arm actuator 380 and, therefore, the position of the locking arm 370 and whether the platen-locking system is in its locked or unlocked configuration. As best shown in FIGS. 2 and 3, in this example embodiment the actuator-control system 390 includes a pneumatic circuit including a compressor 391, an accumulator 392, a pressure sensor 393, a pressure-relief valve 394, and a control valve 395, all of which are mounted to the platen 300, and more particularly the platen frame 302, in this example embodiment. The compressor 391 is configured to generate pressurized air and direct the pressurized air (via a suitable air line, not labeled) to the accumulator 392, which is configured to store the pressurized air and to deliver the pressurized air to the pressure-relief valve 394. The pressure sensor 393 is configured to detect the pressure of the air inside the accumulator $P_{ACCUMULATOR}$. The pressure-relief valve 394 has a routing configuration and a venting configuration. When the pressure-relief valve 394 is in the routing configuration, the pressure-relief valve 394 directs pressurized air received from the accumulator 392 to the control valve 395. Conversely, when the pressure-relief valve 394 is in the venting configuration, the pressure-relief valve 394 prevents compressed air from flowing from the accumulator 392 to the control valve 395. Additionally, when in the venting configuration, the pressure-relief valve 394 enables pressurized air in the locking-arm actuator 380 to vent to depressurize the locking-arm actuator 380. The control valve 395 is configured to selectively direct pressurized air received from the pressure-relief valve 394 to the first and second openings 382*a* and 382*b* in the cylinder 382 of the locking-arm actuator 380. In this example embodiment, the control valve 395 is a solenoid valve controlled by the controller 800 (described below), though it may be any other suitable valve in other embodiments.

The controller 800 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10. The controller 800 is communicatively and operably connected to the conveyor actuator, the platen actuator 350, the strapping head 500, and the locking-arm actuator 380 to receive signals from and to control those components.

The actuator-control system 390 is operably connected to the locking-arm actuator 380 to control the locking-arm actuator 380 in various ways during operation of the strapping machine 10. Initially, when the strapping machine 10 is deenergized, the platen-locking system is in its locked configuration with the locking arm 370 is in its locked position preventing the platen 300 from lowering. The compressor 391 is off, the accumulator 392 is not charged such that $P_{ACCUMULATOR}$ is atmospheric pressure, the pressure-relief valve 394 is in its routing configuration, the control valve 395 is closed, and the locking-arm actuator 380 is depressurized.

Once the strapping machine 10 is energized (i.e., powered on), the controller 800 prevents operation of the strapping machine 10 until $P_{ACCUMULATOR}$ (i.e., pressure of the air inside the accumulator 392) reaches a target pressure (which is set to ensure proper pressurization and operation of the locking-arm actuator 380). In this example embodiment, the compressor 391 is configured to charge the accumulator 392 (i.e., generate pressurized air and direct it to the accumulator 392) whenever $P_{ACCUMULATOR}$ falls below the target pressure. In certain embodiments, the compressor 391 receives feedback directly (or indirectly) from the pressure sensor 393 and operates based on this feedback. In other embodiments, a pressure sensor (such as the pressure sensor 393 or another separate pressure sensor) sends feedback regarding $P_{ACCUMULATOR}$ to the controller 800, which controls the compressor 391 based on this feedback.

Once the accumulator 392 has been pressurized to the target pressure, the controller 800 enables the strapping machine 10 to operate. To enable operation, the platen-locking system must be in its unlocked configuration. Accordingly, the locking arm 370 must move from its locked position to its unlocked position to enable the platen 300 to descend during operation. To do so, the controller 800 controls the platen actuator 350 to begin rotating the drive shaft 305 and the ratchet-wheel assembly 360 in the raising rotational direction. At the same time, the controller 800 controls the control valve 395 to open and direct pressurized air received from the accumulator 392 via the pressure-relief valve 394 to the first connector opening 382*a* of the cylinder 382 of the locking-arm actuator 380. This pressurizes the cylinder 382 in a manner that causes the piston to attempt to extend the piston rod 384 and move the locking arm 370 to its unlocked position. At this point the ratchet-wheel assembly 360 has not rotated enough to free the locking finger 374, so the teeth 364*t* and 366*t* of the first and second ratchet wheels 364 and 366 prevent the locking arm 370 from rotating. The ratchet-wheel assembly 360 eventually rotates far enough to free the locking finger 374 and, when this occurs, the piston rod 384 extends and moves the locking arm 370 to its unlocked position. The controller 800 then controls the platen actuator 350 to stop raising the platen 300, and the strapping machine 10 is ready to strap a load. In certain embodiments, the strapping machine 10 includes sensors (such as position sensors) configured to detect when the locking arm 370 is in its locked and unlocked positions. In certain such embodiments, the controller is configured to control the platen actuator to stop raising the platen responsive to feedback from one of the sensors detecting that the locking arm has reached its unlocked position.

When an operator inputs a platen-lock instruction to the controller 800, such as by inputting an instruction to deenergize the strapping machine 10, the controller 800 controls the actuator-control system 390 to do so. Specifically, the controller 800 controls the platen actuator 350 to stop rotating the drive shaft 305 so the platen 300 remains suspended. The controller 800 controls the control valve 395 to open and direct pressurized air received from the accumulator 392 via the pressure-relief valve 394 to the second connector opening 382*b* of the cylinder 382 of the locking-arm actuator 380. This pressurizes the cylinder 382 in a manner that causes the piston to attempt to retract the piston rod 384 and move the locking arm 370 to its locked position. At this point the locking finger 374 will engage the outer surfaces 364*t*2 and 366*t*2 of two of the teeth 364*t* and 366*t* of the first and second ratchet wheels 364 and 366 of the ratchet-wheel assembly 360. Once this occurs, the controller 800 controls the platen actuator 350 to begin rotating the drive shaft 305 in the lowering rotational direction. As this occurs, the ratchet wheels 364 and 366 rotate relative to the locking finger 374 until the locking finger 374 is received in the pockets 364*p* and 366*p* and reaches its locked position, preventing further rotation of the drive shaft 305 and the platen 300 from descending. In certain embodiments, the controller is configured to control the platen actuator to stop attempting to lower the platen responsive to feedback from one of the sensors detecting that the locking arm has reached its locked position.

In certain embodiments, the strapping machine 10 includes one or more emergency stop actuators (such as pushbutton switches) communicatively connected to the controller 800. When the strapping machine 10 is energized and the locking arm 370 is in its unlocked position, if the controller 800 receives a signal indicating that an emergency stop actuator has been actuated, the controller 800 switches the pressure-relief valve 394 from its routing configuration to its venting configuration. When this occurs, the locking-arm actuator 380 is depressurized such that the pressurized air in the cylinder 382 vents to atmosphere via the pressure-relief valve 374. With the locking-arm actuator 380 depressurized, the locking arm 370 rotates via gravity into contact with the ratchet-wheel assembly 360. In certain embodiments, the platen actuator 350 immediately stops when the emergency stop actuator is actuated. In these embodiments, a brake within the platen actuator 350 will stop the drive shaft 305 from rotating and thus hold the platen 300 in place. In these instances, the locking arm 370 will not reach its locked position, and the platen actuator 350 prevents the platen 300 from descending any further. But in certain situations, the motor brake may fail or the platen 300 may otherwise continue descending after actuation of the emergency stop actuator. In these instance, the locking arm 370 will eventually reach its locked position and thereafter prevent the platen 300 from descending any further. The accumulator 392 remains pressurized so the strapping machine 10 can be ready to operate quickly after being re-energized following an emergency stop.

Operation of the strapping machine 10 to conduct a strapping process to strap a load is now described. To start the strapping process, the load is moved to a first strapping area atop the conveyor 210 and beneath the platen 300. The controller 800 controls the platen actuator 350 to begin moving the platen 300 toward the conveyor 210 and (eventually) into contact with the load. As this occurs, the controller 800 determines a compressive force applied to the load based on force feedback received from one or more sensors and monitors the applied compressive force. The controller 800 monitors the applied compressive force to determine whether the applied compressive force has reached a target compression force. The target compression force may be any suitable force set by the operator or otherwise. Once the controller 800 determines that the applied compressive force has reached the target compression force, the controller 800 controls the platen actuator 350 to stop moving the platen 300. The controller 800 controls the strapping head(s) 500 to strap the load. The controller 800 then controls the platen actuator 350 to move the platen 300 away from the conveyor 210 so the platen disengages the load, and the load is then moved out of the strapping area.

The platen-locking system of the present disclosure solves the above problems. Unlike existing suspension brackets, the platen locking system enables suspension of the platen at any vertical position. This speeds the deenergizing process and provides more flexibility for operators and service technicians who may desire the platen to be suspended at different heights depending on the situation. It also acts as a failsafe that suspends the platen following actuation of an emergency stop if the motor brake fails. Finally, the platen-locking system is electronically controlled and does not require the operator to manually move any components into place to suspend the platen (though in certain embodiments the strapping machine may include suspension brackets in addition to the platen-locking system).

In certain embodiments, the strapping machine includes a sensor, such as an accelerometer, configured to detect when the platen is descending quicker than desired, such as when the platen is in free fall. In these embodiments, the controller is configured to control the locking-arm actuator to move the locking arm to its locked position when the sensor detects that the platen is descending quicker than desired.

The invention claimed is:

1. A strapping machine comprising:

a machine frame;

a load supporter;

a platen supported by the machine frame and movable toward and away from the load supporter;

a platen actuator operably connected to the platen and configured to move the platen toward and away from the load supporter;

a platen-locking system having a locked configuration in which the platen-locking system prevents the platen from moving toward the load supporter and an unlocked configuration in which the platen-locking system does not prevent the platen from moving toward the load supporter, wherein the platen-locking system comprises a locking arm movable between a first position and a second position, wherein the platen-locking system is in the locked configuration when the locking arm is in the first position and in the unlocked configuration when the locking arm is in the second position;

a strapping head; and a controller configured to, responsive to receiving a platen-unlock instruction when the locking arm is in the first position, switch the platen-locking system from the locked configuration to the unlocked configuration by:

controlling the platen actuator to begin moving the platen away from the load supporter; and after the platen begins moving away from the load supporter, controlling the platen-locking system to move the locking arm from the first position to the second position.

2. The strapping machine of claim 1, wherein the platen comprises a platen frame and a drive shaft rotatable relative to the platen frame, wherein the drive shaft is configured such that rotation of the drive shaft in a raising rotational direction causes the platen to ascend and rotation of the drive shaft in a lowering rotational direction causes the platen to descend, wherein the platen actuator is operably connected to the drive shaft to rotate the drive shaft in the raising and lowering rotational directions, wherein the platen actuator is separate from the platen-locking system.

3. The strapping machine of claim 2, wherein the machine frame comprises first and second legs comprising first and second toothed racks, wherein the drive shaft comprises first and second pinions rotatable with the drive shaft, wherein the first pinion is meshed with the first toothed rack and the second pinion is meshed with the second toothed rack.

4. The strapping machine of claim 1, wherein the controller is operably connected to the locking arm and configured to cause the locking arm to move from the first position to the second position.

5. The strapping machine of claim 4, wherein the platen-locking system further comprises a locking-arm actuator operably connected to the locking arm to move the locking arm from the first position to the second position, wherein the controller is operably connected to the locking-arm actuator and configured to control the locking-arm actuator.

6. The strapping machine of claim 5, wherein the platen-locking system further comprises a ratchet wheel mounted to and rotatable with the drive shaft, wherein when the locking arm is in the first position, the locking arm engages the ratchet wheel and prevents the ratchet wheel and the drive shaft from rotating in the lowering rotational direction, wherein when the locking arm is in the second position, the locking arm is disengaged from the ratchet wheel such that the ratchet wheel and the drive shaft are rotatable in the lowering rotational direction.

7. The strapping machine of claim 6, wherein the ratchet wheel comprises a body including multiple radially extending teeth, wherein the locking arm is positioned so the locking arm engages at least one of the teeth when in the first position.

8. The strapping machine of claim 7, wherein the teeth are curved in the lowering rotational direction.

9. The strapping machine of claim 8, wherein a pocket is formed between each pair of adjacent teeth, wherein the locking arm further comprises a locking finger, wherein the locking finger is received in one of the pockets when the first arm is in the first position.

10. The strapping machine of claim 9, wherein the locking arm is pivotable between the first and second positions.

11. The strapping machine of claim 6, further comprising an actuator-control system, wherein the controller is operably connected to the locking-arm actuator via the actuator-control system.

12. The strapping machine of claim 11, wherein the locking-arm actuator comprises a pneumatic cylinder, wherein the actuator-control system comprises a pneumatic circuit.

13. The strapping machine of claim 12, wherein the pneumatic circuit comprises:

a pressurized air source;

a control valve in fluid communication with the pressurized air source and configured to selectively direct pressurized air from the pressurized air source to the locking-arm actuator; and a pressure-relief valve in fluid communication with and between the pressurized air source and the control valve, wherein the pressure-relief valve has:

a routing configuration in which the pressure-relief valve directs pressurized air from the pressurized air source to the control valve, and a venting configuration in which the pressure-relief valve prevents pressurized air from flowing from the pressurized air source to the control valve and enables pressurized air to vent from the locking-arm actuator to depressurize the locking-arm actuator.

14. The strapping machine of claim 13, wherein the pneumatic circuit further comprises a compressor configured to generate pressurized air, wherein the pressurized air source comprises an accumulator in fluid communication with the compressor and configured to store pressurized air received from the compressor.

15. The strapping machine of claim 14, further comprising a pressure sensor configured to sense the pressure of the pressurized air within the accumulator, wherein the compressor is configured to generate and send pressurized air to the accumulator when the pressure of the pressurized air within the accumulator is below a target pressure.

16. The strapping machine of claim 13, wherein the controller is operably connected to the control valve and configured to open and close the control valve to selectively direct pressurized air to the locking-arm actuator, wherein the controller is operably connected to the pressure-relief valve and configured to switch the pressure-relief valve between its routing and venting configurations.

17. The strapping machine of claim 16, further comprising an emergency stop actuator communicatively connected to the controller, wherein the controller is configured to, when the emergency stop actuator is actuated and the locking-arm actuator is pressurized, control the pressure-relief valve to switch from its routing configuration to its venting configuration to depressurize the locking-arm actuator.

18. The strapping machine of claim 16, wherein the controller is configured to, responsive to receiving a platen-lock instruction when the locking-arm actuator is in the second position:

control the control valve to pressurize the locking-arm actuator to move the locking arm toward the first position and into contact with the ratchet wheel; and control the platen actuator to rotate the drive shaft and the ratchet wheel in the lowering rotational direction until the locking arm engages the ratchet wheel and prevents further rotation in the lowering rotational direction.

19. The strapping machine of claim 18, wherein the locking-arm actuator includes a double-acting pneumatic cylinder, wherein the control valve is configured to selectively pressurize the locking-arm actuator to move the locking arm between its first and second positions.

20. The strapping machine of claim 1, wherein the controller is further configured to, responsive to receiving a platen-lock instruction when the locking arm is in the second position, switch the platen-locking system from the unlocked configuration to the locked configuration by:

controlling the platen-locking system to move the locking arm from the second position to the first position; and controlling the platen actuator to begin moving the platen toward the load supporter until the locking arm prevents the platen from descending.

* * * * *